United States Patent [19]

Anderson et al.

[11] Patent Number: 4,810,219

[45] Date of Patent: Mar. 7, 1989

[54] LIFE SAVING DEVICE

[76] Inventors: Malcom D. Anderson, 5, Valley Vista Rd.; Donald A. Hadfield, 60, Crestview Rd., both of Pietermaritzburg, South Africa

[21] Appl. No.: 67,011

[22] Filed: Jun. 29, 1987

[51] Int. Cl.[4] ..... B63C 9/00; B63C 9/24

[52] U.S. Cl. ..... 441/80; 441/94

[58] Field of Search ..... 441/80, 92–94, 441/96, 108, 113, 122, 42, 41; 222/5

[56] References Cited

U.S. PATENT DOCUMENTS 4,551,106 11/1985 Prager ..... 441/94

*Primary Examiner*—Sherman D. Basinger

*Attorney, Agent, or Firm*—I. Michael Bak-Boychuk

[57] ABSTRACT

An inflatable flotation assembly includes a compressed gas cylinder stored inside a split housing the parts of which are held together by a releasable pivot on one end and an interlocked pivoted arm at the other end which engages a flexible tab aligned against the gas cylinder. The arm overlies the housing to engage the releasable pivot and when unclasped from this engagement will rotate to pierce the cylinder by deflecting the tab. Thereafter the expansion of a flotation bladder separates the housing while the arm remains interlocked to the tab to control the rate of gas release into the bladder by the angular inertia of the arm around its pivot.

3 Claims, 2 Drawing Sheets

LIFE SAVING DEVICE

BACKGROUND OF THE INVENTION

1. Field of the Invention

The present invention relates to personal flotation devices, and more particularly, to self inflating flotation devices stored on the body of a user.

2. Description of the Prior Art

The incidence of drownings by those participating in water sports is a problem of some concern. The enjoyment and participation in water activities by the public at large occurs with some frequency and, in consequence, the incidence of tragic events is on the rise. For this reason various governmental agencies have issued and enforce regulations compelling boaters to carry flotation devices.

Personal flotation devices, however, are typically bulky and cumbersome and thus are not regularly worn. Less bulky, selectively inflatable, flotation devices are therefore preferred and examples thereof have appeared with some frequency in the various patent teachings. For example U.S. Pat. No. 3,173,162 to Elders discloses a compressed gas inflatable bag, as do U.S. Pat. Nos. 4,551,106, and 3,828,381 both to Prager. Each of these, while suitable for the purposes addressed, entail complex mechanisms and thus fabrication expense and complex maintenance.

Characteristically, the instant flotation devices attend extremely significant circumstances. Reliable operation is thus of paramount concern, as is the convenience of the article before deployment. In substantially all instances the article accompanies very vigorous physical activity, in an environment frequently characterized by salt water, sand, and the material deterioration by exposure to sunlight Concurrently, accidental discharge of the compressed gas, in itself, poses its own hazards. Thus any inflatable device intended to be worn by the water sportsman must be reliable, rugged and convenient in use. It is one such arrangement that is disclosed herein.

SUMMARY OF THE INVENTION

Accordingly, it is the general purpose and object of the present invention to provide a releasable housing for a compressed gas flotation assembly which is positively engaged when not in use.

Other objects of the present invention are to provide an overlapping closure which fully protects the collapsed flotation device in the course of storage.

Further objects of the invention are to provide an inflatable flotation device which is convenient in assembly and in recharging.

Yet further objects of the present invention are to provide a releasable flotation assembly which is convenient in fabrication and in use.

Briefly, these and other objects are accomplished within the present invention by providing an elongate split housing including a base cavity hinged at one end to a hollow cover provided with an interior spring clasp at the other end for closure The clasping end of the base, moreover, pivotally engages an overlying clamping piece which extends over the cover to engage by a springed engagement the pivotal connection of the cover with the base. Once released the clamping piece directs a cantilevered extension against the spring clasp of the cover, releasing its engagement from the base. This same deflection of the clasp by the cantelevered extension of the clamping piece also pierces a seal at the end of a compressed gas bottle stored within the housing and connected to an inflatable bladder folded along the sides thereof. As the bladder then fills with gas between the base and the cover the clamping piece is displaced pivotally even further, promoting further perforation of the seal. Thus a servo actuation of the piercing stroke is assured upon the release of the clamping piece. Thereafter the clamping piece and cover are flung apart by the expansion of the bladder which continues to expand to the volume of the compressed gas stored in the bottle. A line or tether connected between the now expanded bladder and the housing then keeps the expanded bladder next to the person of the user.

In this form an expedient self actuating flotation assembly is provided which may be worn on the wrist or the waist of a person and which is rendered effective by the simple expedient of releasing a spring clasp. Once this release is made all further steps in the deployment sequence are thereafter self effecting and the user is thus unencumbered with a detailed or complicated task during an emergency.

To achieve this reliable result the spacing of the housing between which the gas bottle is stored is accuratley dimensioned and the flexure dimension of the clamping piece is geometrically determined by the pivotal geometry of the extension. These geometric constraints are then accomodated in the course of assembly by chamfered pivot stubs in the base. The cover thus may contain, stored as a blister pack, the gas bottle and the collapsed bladder and in this form may be pressed onto the pivot stubs to complete the article.

DESCRIPTION OF THE PREFERRED EMBODIMENT

Figure 1:
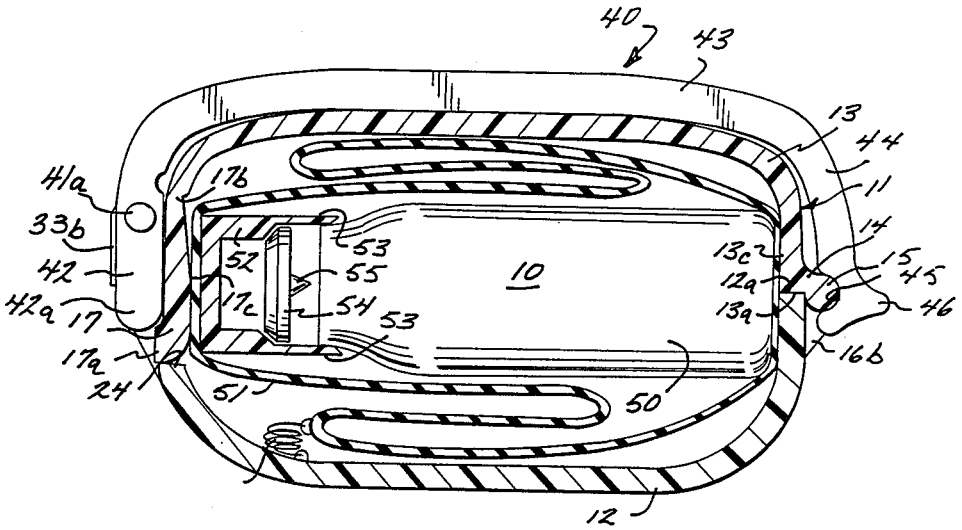
FIG. 1 is a side view, in section, of the inventive flotation article in its stored form.
Figure 2:
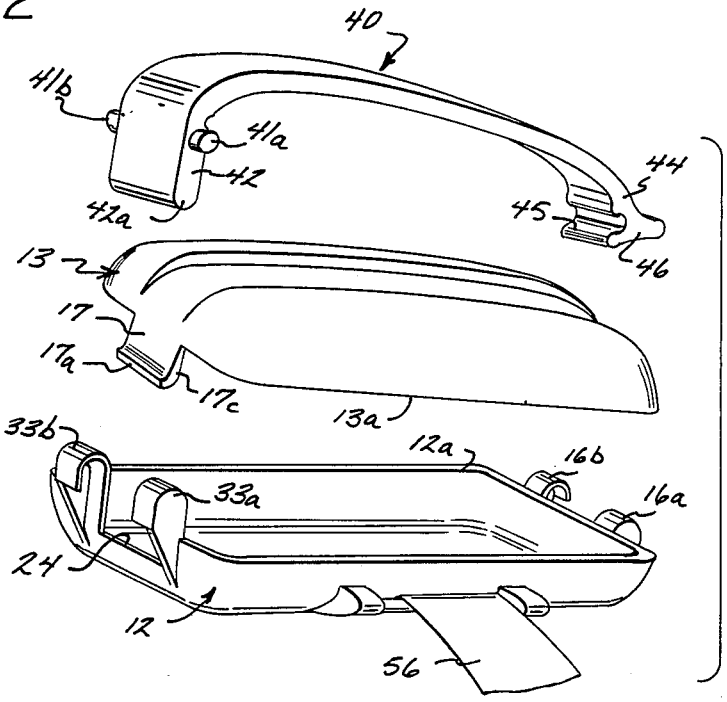
FIG. 2 is a perspective view, separated by parts, of the deployable housing in accordance with the present invention.
Figure 3:
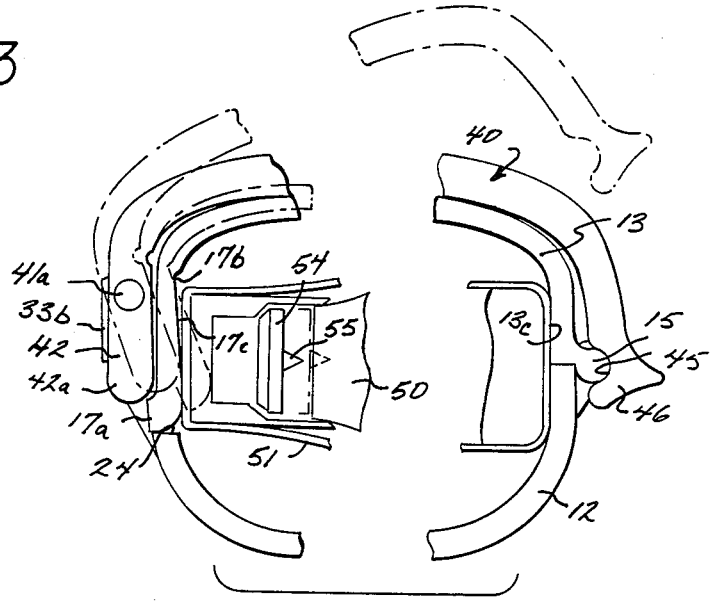
FIG. 3 is a side view, in several details, of the inventive article in the course of use.
Figure 4:
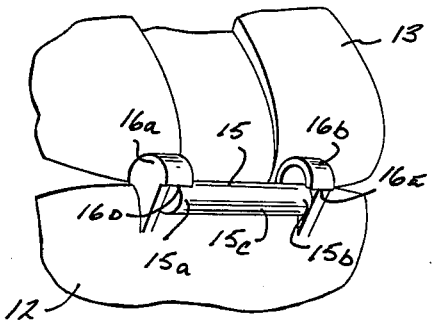
FIG. 4 is a perspective illustration of a rear view detail of the inventive article in the course of deployment.
Figure 5:
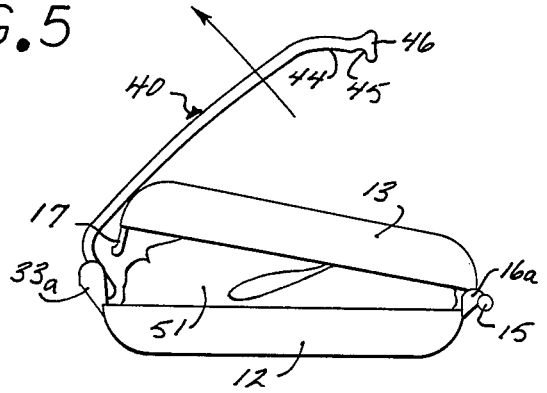
FIG. 5 is yet another side view of the inventive article completing the deployment thereof.

As shown in FIGS. 1–5 the inventive flotation assembly, generally designated by the numeral 10, comprises a hollow split housing 11 including a dished hollow base 12 and a mating, dished, hollow cover 13. Both the cover and the base are formed to an elongate rectangular planform, each presenting a mating peripheral edge **12*a* and 13*a* aligned towards each other. At one end both the cover and the base are releasably hinged to each other at an exteriorly protruding pivotal pin 15 offset on a web 14 from the cover 13 to present pin ends 15*a* and 15*b* for engagement underneath two pivot ears 16*a* and 16*b* extending in spaced alignment from the mating portion of base 12. A central segment of the pivot pin 15, shown as segment 15*c* is thus exposed between the spaced ears 16*a* and 16*b*** to serve as a latching projection for use described at length hereinbelow.

At the opposite end cover 13 is provided with a projecting, substantially rectangular tab 17 extending beyond the plane of edge 13*a* and formed to a reduced section at the root 17*b* thereof for resilient bending.

Preferably, both the base and the cover are formed of a polymeric material structure, such as one of the many polymers like polyvinylchloride, polyurethane or one of the polymers in the Nylon group, and thus are characterized by some resiliency and flexure in their structure. Tab 17, consequently, exhibits some flexure in cantilever localized mainly at its reduced section roof 17*b* and thus may be used as a spring latch to engage the free ends of the base 12 and cover 13 in accordance with the description.

To effect this latching engagement the free edge of tab 17 is turned outwardly as a latching ledge 17*a*. More specifically, to accommodate tab 17 the adjoining edge surface of base 12 is cut away in a conforming cutout 24 which then exposes the surface of tab 17 for inward displacement. Two laterally spaced pivot ears 33*a* and 33*b* are then formed on the exterior of edge 12*a* adjacent the lateral edges of the cut-out 24 for receipt of pin stubs 41*a* and 41*b* extending transversely across an orthogonal projection 42 formed on one end of an elongate latching piece generally at 40. Consequently, a portion of the projection 42, shown at 42*a*, extends radially beyond the pivot axis defined by the pin stubs 41*a* and 41*b* to overlie the exposed surface of tab 17. Thus, any pivotal motion of piece 40 about this axis will advance the radial portion 42*a* against tab 17 displacing the tab inwardly. In the course of this pivotal motion the radial free edge of the portion 42*a* abuts against a ledge 17*a* to maintain an interlock and further inward flexure of tab 17 occurs in the course of opening.

A compressed gas bottle 50, hermetically sealed to an inflatable bag 51, is received between the interior surface 17*c* of tab 17 and the opposing interior surface 13*c* formed within the cover 13. The compressed gas bottle 50 includes an axially moveable cap structure 52 supported by legs 53 against the bottle which, when displaced by the inward flexure of tab 17, will then drive a piercing disc 54 against the bottle end to permit the release of gas into the inflatable bag or bladder 51. This bag or bladder is stored in housing 11, in folded or rolled form, on either side of the bottle 50 until thus expanded.

Once the bottle is pierced the release of compressed gas from the bottle into the expanding bladder forces further pivotal motion of the cover 13 which can only occur in association with further pivotal motion of piece 40 necessary to accommodate the radial geometry of the portion 42*a* around its pivot and the engagement thereof with ledge 17*a*. Thus, the further release of the compressed gas forces a lateral displacement of cover 13 against the ears 16*a* and 16*b*. This lateral forcing continues until a radial alignment of the cover 13 is reached at which the offset pin 15 can pass underneath the exterior retaining edges 16*d* and 16*e* of the ears 16*a* and 16*b*, as illustrated in detail in FIG. 4.

Those skilled in the art will also appreciate that the passage of gas through an orifice is generally determined by the orifice size and the pressure differential thereacross. As a first approximation, therefore, the inflation of bag 51 is generally an exponential function of an exponent less than 1. The kinematic response of the clamping piece 40 is generally related to the angle of projection 42 around the pivot, *a* cosine function. Thus as the bag volume is rising quickly the geometric engagement of piece 40 against tab produces small angular acceleration of the piece 40 around its pivot 41. Consequently the period of inward deflection of tab 17 is prolonged by this geometry to insure effective piercing of any seal in the bottle and to control the bag expansion rate.

Accordingly, during the portion of the pivotal stroke at which the cover, base and piece 40 are geometrically interlocked disc 54 is pressed with its piercing projection 55 maintained within the pierced opening in the bottle. In consequence some flow restriction is imposed on the released gas at the point of highest pressure differential. The self-effected expansion transient of the bag is thus controlled by the geometry and inertia of the interlocked elements, reducing the incidence of shock and trauma to the user.

Those skilled in the art will further note that once bottle 50 is pierced all further actuation of the device is self effected by the servo arrangement achieved in the foregoing engaged geometry. This servo effect is controlled by the kinematic response of the latching piece 40 characterized by an elongate, somewhat massive body 43 extending from the orthogonal projection 42 over the exterior of the cover 13 to yet another orthogonal projection 44 provided with a recess 45 aligned to engage the exposed portion of pivot pin 15 on the other end of the housing 11. A finger pull or extension 46, extending from the orthogonal 44, is then useful to release and lift the latching piece 40 from this engagement commencing the pivotal motion thereof around the pin stubs 41*a* and 41*b*. This same motion displaces inwardly tab 17 to commence the release of gas from bottle 50, as described above.

Of course, the bladder may be tethered against subsequent loss by a line 55 tied to the housing 11 and the housing 11 may, in turn, be affixed to the body of the user by a belt or wrist strap 56. Moreover to accommodate assembly and reuse or reloading with a new bottle and bladder combination pin stubs 41*a* and 41*b* are chamfered at their end surfaces and thus may be manually pressed into engagement between the ears.

Accordingly, both the assembly and the release are conveniently accommodated in the structure set out. Moreover, since a substantial mechanical advantage is provided in the geometry of piece 40 the pierced surface of bottle 50 need not be pre-dimpled or partly pre-pierced as is customary in the art. There is, therefore, a greater manufacturing convenience and consequent cost reduction while concurrently the necessary reliability and safety are retained by virtue of the structure described.

Obviously, many modifications and changes may be made to the foregoing without departing from the spirit of the invention. It is therefore intended that the scope of the invention be determined solely on the claims appended hereto.

What is claimed is:

1. An inflatable flotation assembly conformed for attachment to the body of a user, comprising:

a hollow, generally dished, elongate base defined by a first planar edge;

a hollow, generally dished, elongate cover defined by a second planar edge, said first and second edges being conformed for mating abuttment over a portion thereof;

a pivot pin attached to one end of said cover in an offset exterior alignment relative said second edge;

pivot engagement means formed on the exterior of said base for engaging said pivot pin over a first portion of pivotal motion of said cover relative said base and for releasing said engagement of said pivot pin over a second portion of pivotal motion of said cover relative said base;

a flexible projection formed on the other end of said cover and aligned for inward flexure relative thereto;

a radial engagement means formed on the exterior of the other end of said base in spaced alignment relative said projection;

an arcuate arm conformed for pivotal attachment proximate one end thereof with said radial engagement means and for releasable clasping proximate the other end thereof to said pivot pin, said arm including a radial lever at said one end thereof in alignment over said projection for urging inward flexure of said projection upon the unclasping and pivotal articulation thereof; and compressed gas means received within said cover and aligned for releasing gas in response to said inward flexure of said projection.

2. Apparatus according to claim 1 further comprising:

an inflatable membrane stored subjacent said cover and connected to receive the released gas from said compressed gas means, said membrane being aligned between said base and said cover for urging the separation therebetween upon receipt of said gas.

3. Apparatus according to claim 1 wherein said projection includes an exteriorly directed lip at the free edge thereof directed to engage said lever.

* * * * *